United States Patent [19]

Ford

[11] Patent Number: 5,067,430

[45] Date of Patent: Nov. 26, 1991

[54] ANCHOR WITH AXIS CONTROL BAR

[75] Inventor: Charles H. Ford, Oakland, Calif.

[73] Assignee: The Charles Henry Ford Trust, Oakland, Calif.

[21] Appl. No.: 534,781

[22] Filed: Jun. 7, 1990

[51] Int. Cl.[5] ..... B63B 21/34

[52] U.S. Cl. ..... 114/294; 114/301; 114/310

[58] Field of Search ..... 114/294, 301, 304, 309, 114/310; D12/215

[56] References Cited

U.S. PATENT DOCUMENTS

| | | | |
|---|---|---|---|
| 2,249,546 | 7/1941 | Danforth | 114/309 |
| 3,749,044 | 7/1973 | Klaren | 114/301 |
| 3,782,318 | 1/1974 | Hungerford | 114/309 |
| 3,783,815 | 1/1974 | Towne et al. | 114/310 |
| 4,706,595 | 11/1987 | Von den Haak | 114/294 X |

OTHER PUBLICATIONS

Publication: "The World's Finest Danforth Anchors", 2 pages.

*Primary Examiner*—Sherman Basinger
*Attorney, Agent, or Firm*—Townsend and Townsend

[57] ABSTRACT

An anchor including an axis control bar for holding a vessel in place. The anchor has a pair of planes extending from a crown made up of two flat vanes. An axis control bar is connected between the planes for providing enhanced structural strength and leverage for releasing the anchor from a set position.

27 Claims, 4 Drawing Sheets

ANCHOR WITH AXIS CONTROL BAR

BACKGROUND OF THE INVENTION

The present invention relates to anchors. More particularly, the present invention is a one piece anchor with an axis control bar.

Twin fluke anchors are widely used for anchoring all types of boats including fishing boats, commercial ships, pleasure crafts, and war vessels. One such anchor is the Danforth anchor described in U.S. Pat. No. 2,249,546. The basic design of a twin fluke anchor includes two flukes which extend from a bar. Attached to the bar is a shank which pivots about the bar at one end and is attached to a chain or a rope at the other end. A crown is also attached to the bar to prop up one end of the anchor and bias the tips of the flukes into the bottom surface. As the anchor is pulled by the chain or rope attached to the shank, the flukes penetrate the bottom surface.

Twin fluke anchors including a pivoting shank have a number of disadvantages. First, the setting of a twin fluke anchor may require an extended drifting distance. This is because the unpredictable pivotal movement of the shank, depending on how the anchor lands on the bottom. Further, retrieval of a twin fluke anchor also relies on the movement of the pivoting shank. If the shank and/or the stock becomes stuck or inoperative, difficulty may be encountered in releasing the anchor from its set position on the bottom.

Another problem with the configuration of twin fluke anchors is that the pivoting shank creates a risk of injury to the user. Most anchors are heavy and if lifted carelessly, may catch a finger or toe of a user between the pivoting shank and the flukes. As the shank rotates, the finger or toe may be injured. This is especially true in the case of children who may find the anchor heavy and hard to manage.

SUMMARY OF THE INVENTION

The present invention provides an anchor with an axis control bar which overcomes the disadvantages of prior art twin fluke style anchors. The present invention includes a pair of flukes which are joined at one end in a V-shaped structure, each having a point at the other end. A crown is attached to the junction point of the two flukes to prop the anchor up in a manner similar to prior art anchors. The present invention also includes an axis control bar connected between the two flukes for stability and ease of release from the bottom. A chain, a rope 81' or any article for achieving the same function is attached to the base of the crown at the interior of the V formed by the two flukes. The chain or rope is also situated about the axis control bar as shown by reference numeral 85' in FIG. 10.

The advantages achieved by the anchor of the present invention are numerous. First, the elimination of moving parts reduces the number of injuries associated with the moving parts. Second, the structure provides for more reliable setting of the anchor with less drifting distance. Third, the positioning of the axis control bar, which is circumscribed by a link in the chain, provides easier release of the anchor. Fourth, manufacturing can be achieved with the use of a single slab of material and with reduced cost as compared to an anchor including moving parts. Finally, the present invention is more compact and far stronger due to its structural design.

For a more complete understanding of the nature and advantages of the invention, reference should be made to the ensuing detailed description in conjunction with the accompanying drawings.

According to an embodiment of the invention, the angle between the flukes is approximately 45°. According to an embodiment of the invention the angle between one of the flukes and the axis control bar is approximately 45°, and the interior angle between the other of the flukes and the axis control bar is approximately 45°. According to an embodiment of the invention, a means for securing the anchor is a rope. According to an embodiment of the invention, a rope for securing the anchor is coupled to the axis control bar. According to an embodiment of the invention, the axis control bar is positioned halfway between the points at the ends of the flukes and an interior junction point of the flukes. According to an embodiment of the invention the axis control bar is positioned forward of a halfway point between points at the end of the flukes and an interior junction point of the flukes.

DETAILED DESCRIPTION OF THE DRAWINGS

Figure 1:
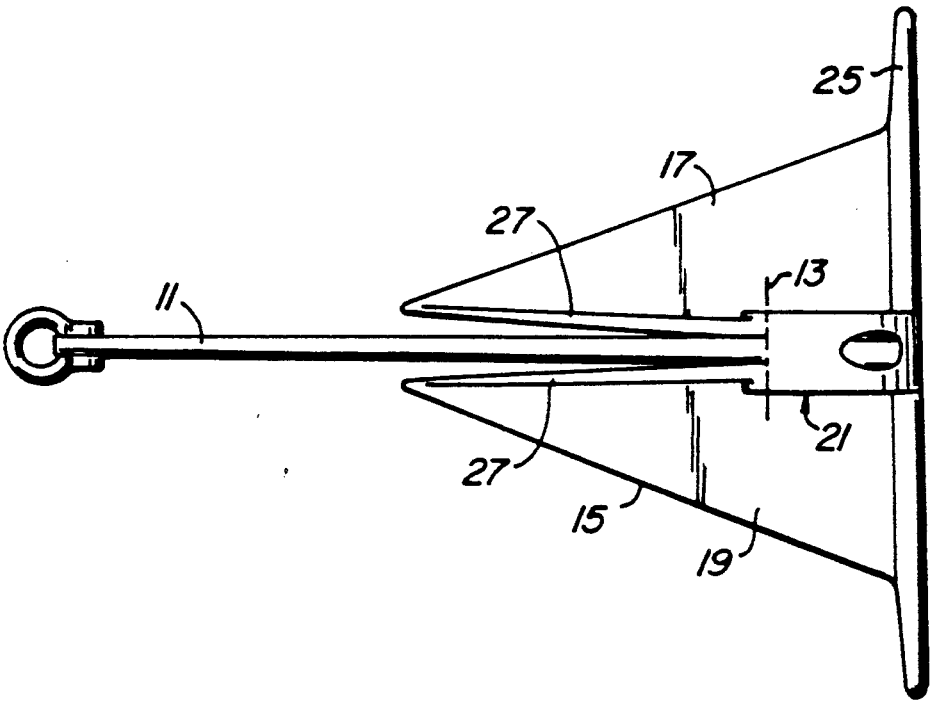
FIG. 1. PRIOR ART
FIG. 1 is a top level view of a prior art anchor.
Figure 2:
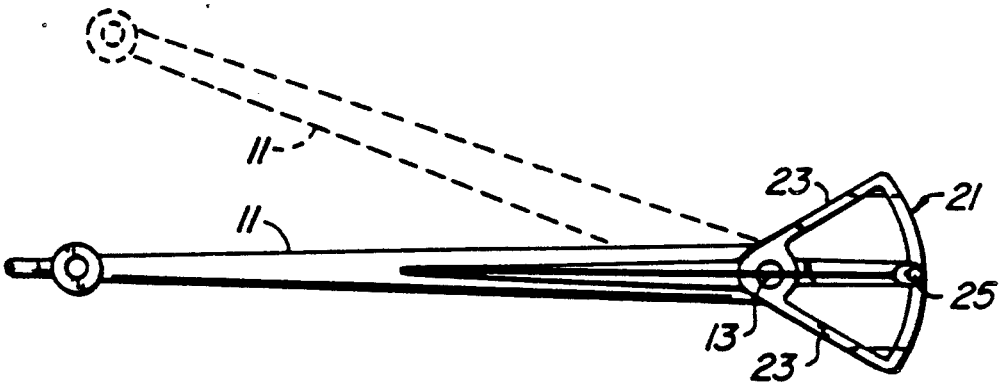
FIG. 2. PRIOR ART
FIG. 2 is a side view of a prior art anchor.

FIGS. 1 and 2 show a top level view and a side view of a prior art anchor, respectively. A shank 11 is pivotally mounted at point 13 on fluke structure 15. Fluke structure 15 includes two generally triangularly shaped flukes 17 and 19. Fluke structure 15 is formed to provide a one-piece fluke structure with shank 11 pivoted therebetween. At the rear end of flukes 17 and 19 is a crown portion 21. Crown portion 21 includes rearwardly sloping faces 23 which engage the bottom surface as the anchor is drawn forward and cause the rear end of flukes 17 and 19 to be lifted. Crown faces 23 slope rearwardly and slide over the ground effecting the desired rotation of the flukes into operative position as they become buried in the bottom. An extension 25 is provided on each fluke to serve as a stop.

Flukes 17 and 19 are triangular in outline. The inner edge of each fluke is formed with a rib 27 which slopes outwardly away from the adjacent shank at an angle.

Figure 3:
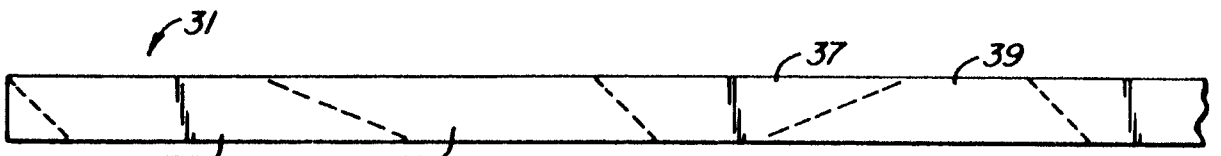
FIG. 3 is a diagram showing a slab of material from which the components of a one-piece anchor may be cut.
Figure 4:
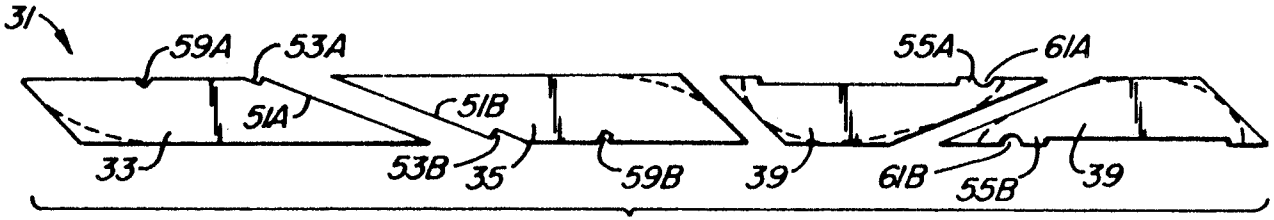
FIG. 4 shows the slab of material of FIG. 3 cut into the components of an anchor.

FIG. 3 is a diagram showing a slab of material 31 from which the components of an anchor in accordance with the present invention are cut. FIG. 4 shows the same slab of material 31 after cutting has been performed. There are five components in a preferred embodiment. These components are a first plane 33, a second plane 35, a first vane 37, a second vane 39, and an axis control bar (see FIGS. 5–9). As can be seen from FIG. 3, planes 33 and 35 and vanes 37 and 39 can be efficiently cut with a minimum of wasted material.

Once these components have been cut from slab 31, they are shaped to a proper form to be joined to form the anchor. Shaping is required to eliminate the sharp edges and pointed corners thereby reducing the chance of injury to a user or damage to a vessel. In addition, notches are cut in the various components to enhance the strength of the structure when the components are joined. Notches 59A and 59B are made for the purpose of connecting axis control bar 57 and notches 61A and 61B are made to create a hole where a chain or rope can be secured to the completely assembled anchor. Notches 53A and 53B are formed to receive extensions 55A and 55B of first and second vanes 37 and 39.

Figure 5:
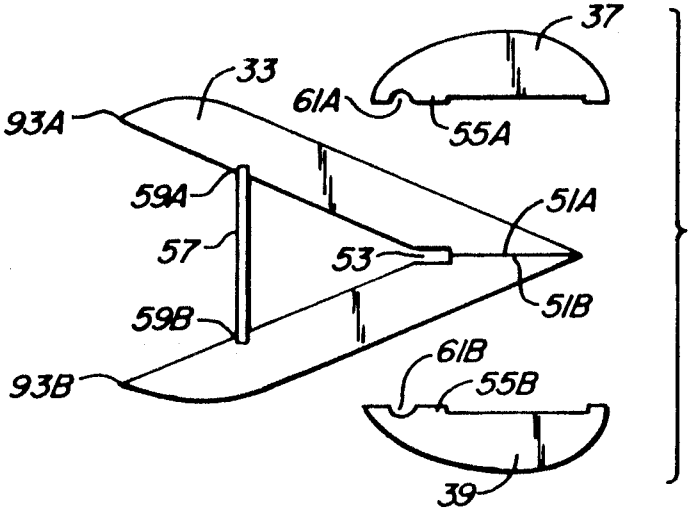
FIG. 5 is a top level view of an anchor with the crown components unattached.

FIG. 5 is a top level view of an anchor with the crown components unattached. First plane 33 and second plane 35 have been joined along edges 51A and 51B. Notches 53A and 53B meet to form a squared-off notch 53 into which an extension 55A on first vane 37 and an extension 55B on second vane 39 are received. An axis control bar 57 is joined to first plane 33 and second plane 35 in notches 59A and 59B, respectively. Axis control bar 57 provides added strength to the structure of the anchor as well as providing a means for leveraging the release of the anchor from the bottom surface.

Figure 6:
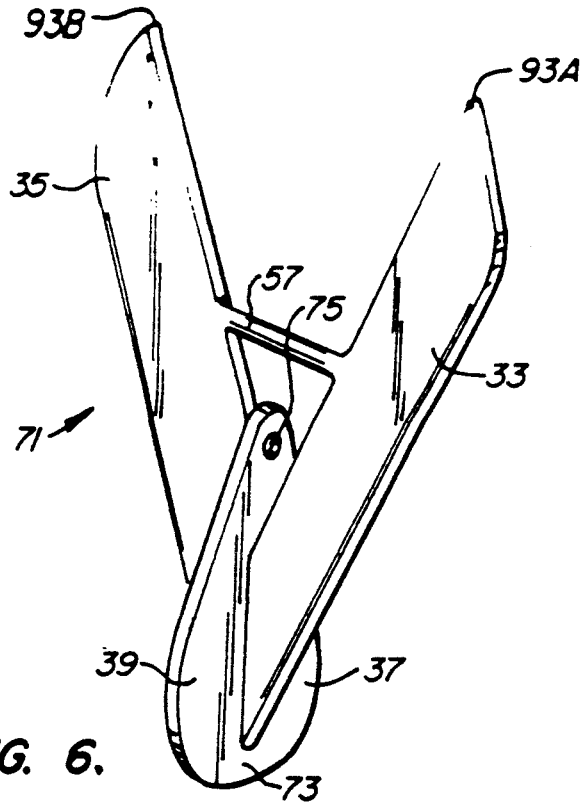
FIG. 6 is a view of an anchor as assembled.

FIG. 6 is a view of a fully assembled anchor excluding a chain or flexible shank. Anchor 71 includes a crown 73 formed from the joinder of first vane 37 and second vane 39. A hole 75 is formed where notches 61A and 61B meet. This hole is used to secure a chain, rope or flexible shank which provides an anchor attachment for an anchor rode to a vessel.

Figure 7:
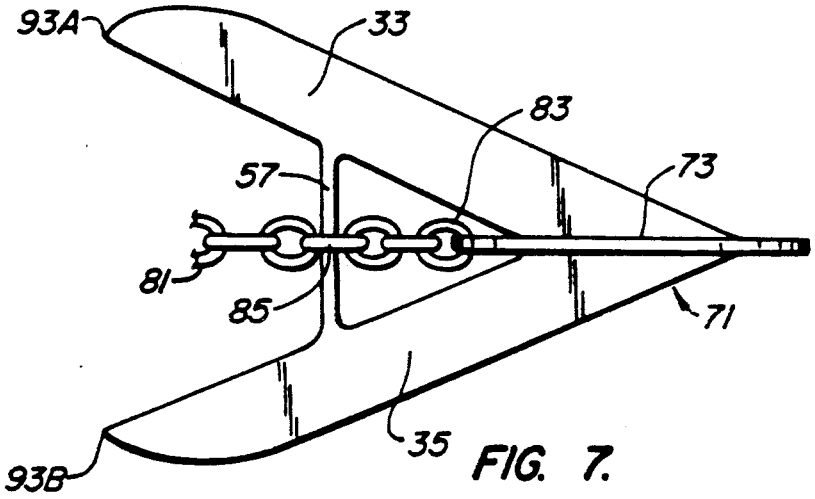
FIG. 7 shows a top level view of an anchor with a chain attached.

FIG. 7 is a top level view of anchor 71 with chain 81 secured thereto. Chain 81 is attached by threading link 83 through hole 75. In addition, link 85 is formed around axis control bar 57 for stability and to allow pivoting of the unit to ease the retrieval of anchor 71 from the bottom surface. If chain 81 is pulled in a direction between points 93A and 93B, link 83 does not contact axis control bar 57. In this way, chain 81 acts to place force at crown 73 via link 83. This force is used to bury anchor 71 in a bottom surface. However, if chain 81 is pulled in an upward direction, link 85 contacts axis control bar 57 and causes anchor 71 to pivot about axis control bar 57 to be easily released. Further, if anchor 71 becomes stuck for any reason, a user may pull his boat ahead of anchor 71 and pull on chain 81. Link 85 will contact axis control bar 57 and anchor 71 will move in a rearward direction in a straight line as guided by the lower vane. At this point lower vane 39 (FIG. 8) acts as a rudder to steer anchor 71 from its stuck position.

Figure 8:
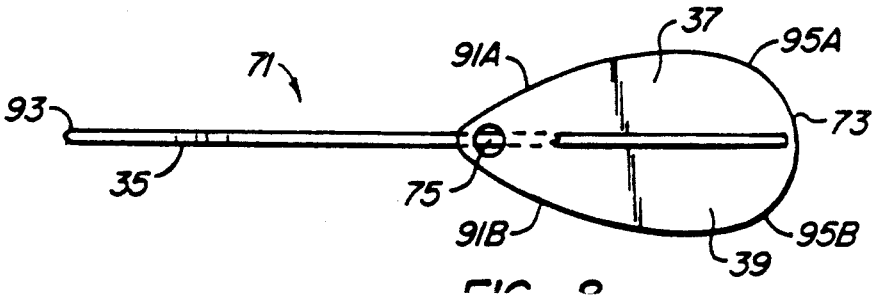
FIG. 8 shows a side view of an anchor.

FIG. 8 shows a side view of anchor 71. Crown 73 is shaped with sloping edges 91A and 91B to provide resistance to the bottom surface as anchor 71 is pulled along the bottom in a direction for burying planes 33 and 35. This causes points 93 to penetrate the bottom surface and bury anchor 71 in place to hold a boat. The length of planes 33 and 35 may be lengthened to achieve greater burying capacity. A change in the height of vanes 37 and 39 also increases the burying capacity accordingly.

In addition, sloping edges 95A and 95B are provided to ease the movement of anchor 71 rearwardly. This is useful when anchor 71 becomes wedged. Further, vanes 37 and 39 act as rudders when in contact with the bottom surface to guide anchor 71 to a place where penetration occurs evenly at both points 93A and 93B.

Figure 9:
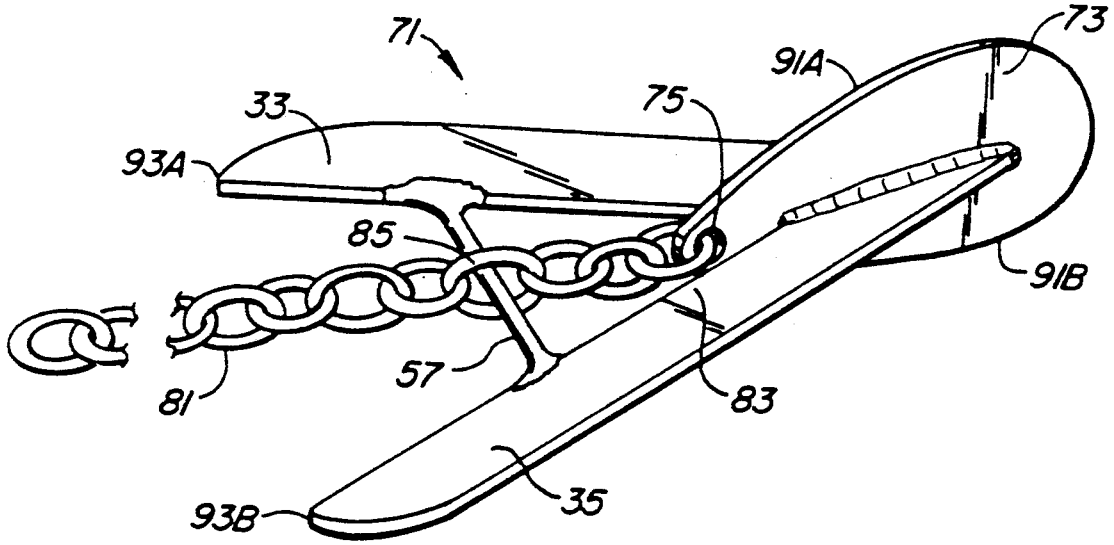
FIG. 9 shows an anchor with a crown and chain.
Figure 10:
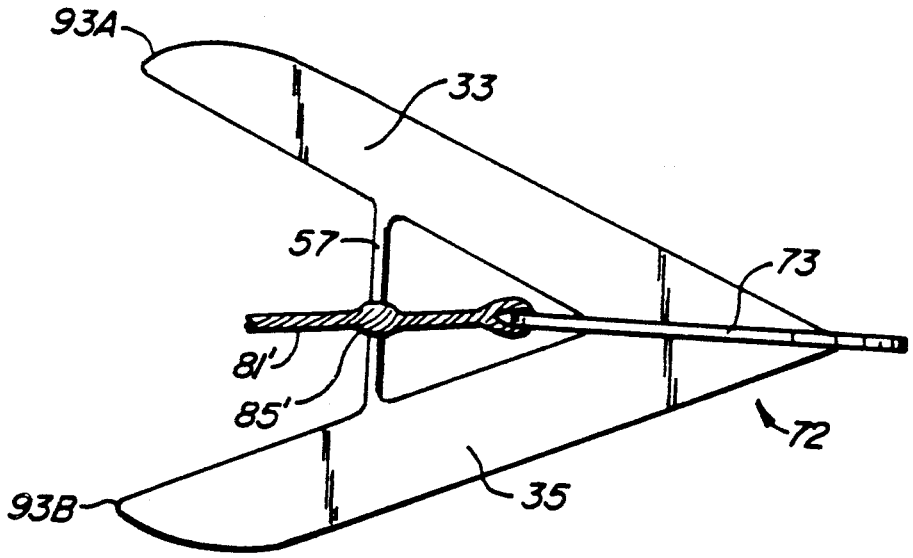
FIG. 10 shows a top level view of an anchor with a rope attached.

FIG. 9 shows anchor 71 with chain 81 and crown 73. Axis control bar 57 provides leverage to a person pulling on chain 81 thereby permitting easier release of anchor 71 from a buried position on the bottom.

Figure 11:
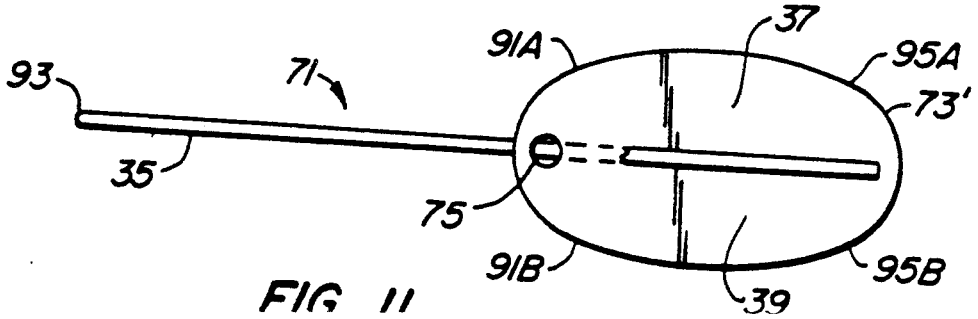
FIG. 11 shows a side view of an anchor according to one embodiment of the invention.

In general, to those skilled in the art to which this invention relates, many changes in construction and widely differing embodiments and applications of the present invention will suggest themselves without departing from its spirit and scope. For instance, crown portion 73' (FIG. 11) works efficiently in elliptical form for rearward movement. However, crown portion 73 may be in a variety of shapes as long as it includes sloping edges 91A and 91B. For example, although not as efficient for reverse movement purposes, crown 73 could be squared-off. Additionally, flukes 33 and 35 could be formed of cylindrical material rather than a flat slab. Anchors 71 could be made as a one-piece or two-piece casting as well. Thus, the disclosures and descriptions herein are purely illustrative and are not intended to be in any sense limiting. The scope of the invention is set forth in the appended claims.

What is claimed is:

1. An anchor including no moving parts, comprising:

a first planar member having a first end and a second end formed with a point;

a second planar member having a first end and a second end formed with a point, the first end of said second planar member being joined to said first end of said first planar member such that said first and second planar members are in the shape of a "V";

an axis control bar extending between said first planar member and said second planar member;

a first vane joined to a first side and at said first ends of said first and second planar members in a plane substantially perpendicular to said first and second planar members;

a second vane joined to a second side and at said first ends of said first and second planar members in a plane substantially perpendicular to said first and second planar members; and a first means for receiving and attaching a chain or rope to said anchor, said first means being spaced from said axis control bar, and said first means being non-moving with respect to said first and second planar members.

2. An anchor including no moving parts, comprising:

a first planar member having a first end and a second end formed with a point;

a second planar member having a first end and a second end formed with a point, the first end of said second planar member being joined to said first end of said first planar member such that said first and second planar members are in the shape of a "V";

an axis control bar extending between said first planar member and said second planar member;

a first vane joined to a first side and at said first ends of said first and second planar members in a plane substantially perpendicular to said first and second planar members;

a second vane joined to a second side and at said first ends of said first and second planar members in a plane substantially perpendicular to said first and second planar members;

wherein said first and second vanes form a crown portion which is substantially elliptical in shape.

3. The anchor of claim 1 wherein an angle between said first and second planar member is approximately 45 degrees.

4. The anchor of claim 1 wherein an interior angle between said first planar member and said axis control bar is approximately 45 degrees.

5. The anchor of claim 1 wherein an interior angle between said second planar member and said axis control bar is approximately 45 degrees.

6. An anchor including no moving parts, comprising:

a first planar member having a first end and a second end formed with a point;

a second planar member having a first end and a second end formed with a point, the first end of said second planar member being joined to said first end of said first planar member such that said first and second planar members are in the shape of a "V";

an axis control bar extending between said first planar member and said second planar member;

a first vane joined to a first side and at said first ends of said first and second planar members in a plane substantially perpendicular to said first and second planar members;

a second vane joined to a second side and at said first ends of said first and second planar members in a plane substantially perpendicular to said first and second planar members;

wherein said first and second vanes extend along a junction between said first and second planar members and beyond said first and second planar members to an interior side of said "V".

7. The anchor of claim 6 wherein an area formed at a junction between said first and second vanes beyond said first and second planar members includes a hole in which means for securing the anchor may be secured.

8. The anchor of claim 7 wherein said means for securing is a chain.

9. The anchor of claim 8 wherein said axis control bar is through a link in said chain but not in contact with said link when said chain is pulled in a forward direction.

10. The anchor of claim 8 wherein said axis control bar is through and in contact with said link when said chain is pulled in a rearward direction.

11. The anchor of claim 8 wherein said axis control bar is through and in contact with said link when said chain is pulled in an upward direction.

12. The anchor of claim 7 wherein said means for securing is a rope.

13. The anchor of claim 12 wherein said rope is coupled to said axis control bar.

14. The anchor of claim 1 wherein said first and second vanes extend along a junction between said first and second planar members and beyond said first and second planar members to an exterior side of said "V".

15. The anchor of claim 1 wherein said first and second planar members are substantially flat.

16. The anchor of claim 1 wherein said first and second vanes are substantially flat.

17. The anchor of claim 1 wherein said axis control bar is positioned half-way between said points on said first and second planar members and an interior junction point of said first and second planar members.

18. The anchor of claim 1 wherein said axis control bar is positioned forward of a half-way point between said points on said first and second planar members and an interior junction point of said first and second planar members.

19. A one-piece anchor comprising:

a V-shaped body having first and second legs joined at an apex region and having spaced-apart outer ends;

means, extending from the apex region, for raising the apex region relative to the outer ends when the anchor is on a surface;

an axis control bar extending between the first and second legs at a control position located between the apex region and the outer ends; and an attachment point at the apex region;

whereby attachment of one end of an anchor rode to the attachment point and attachment of the anchor rode to the axis control bar permits the anchor to be securely set by pulling on the anchor rode in a direction tending toward the plane of the body, the anchor being dislodged by pulling on the anchor rode in a direction transverse to the plane of the body so to pull on the anchor through the axis control bar.

20. The anchor of claim 19 wherein the body is generally flat.

21. The anchor of claim 19 wherein the raising means includes a teardrop-shaped planar member extending on both sides of the body generally perpendicular to the plane of the body.

22. A one-piece anchor comprising:

a V-shaped body having first and second legs joined at an apex region and having spaced-apart outer ends;

means, extending from the apex region, for raising the apex region relative to the outer ends when the anchor is on a surface;

an axis control bar extending between the first and second legs at a control position located between the apex region and the outer ends; and an attachment point at the apex region;

a chain providing a rode to a vessel coupled to the attachment point and the axis control bar;

whereby attachment of one end of the rode to the attachment point and attachment of the rode to the axis control bar permits the anchor to be securely set by pulling on the rode in a direction tending toward the plane of the body, the anchor being dislodged by pulling on the rode in a direction transverse to the plane of the body so to pull on the anchor through the axis control bar.

23. The anchor of claim 22 wherein the body is generally flat.

24. The anchor of claim 22 wherein the raising means includes a teardrop-shaped planar member extending on both sides of the body generally perpendicular to the plane of the body.

25. An anchor of claim 1, wherein said means for attaching includes a hole in which means for securing the anchor may be secured and in which said means for securing is coupled to said means for attaching and also coupled to said axis control bar.

26. The anchor of claim 1, wherein said first and second planar members lie in substantially the same plane and wherein said first and second vanes lie in substantially the same plane, the plane of the first and second vanes being substantially perpendicular to the plane of said first and second planar members.

27. The anchor of claim 1, wherein said first vane includes an edge which is sloped with respect to said first planar member.

* * * * *